US008424715B2

(12) United States Patent
Aiken et al.

(10) Patent No.: US 8,424,715 B2
(45) Date of Patent: Apr. 23, 2013

(54) WASTE CONTAINER

(75) Inventors: Cynthia R. Aiken, Atlanta, GA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1812 days.

(21) Appl. No.: 10/442,716

(22) Filed: May 21, 2003

(65) Prior Publication Data

US 2004/0232158 A1 Nov. 25, 2004

(51) Int. Cl.
*B65D 25/28* (2006.01)
*B65D 55/00* (2006.01)

(52) U.S. Cl.
USPC ..... 220/761; 220/762; 220/764

(58) Field of Classification Search ..... 220/761, 220/762, 771, 908, 909, 756, 764, 763; 280/47.315
See application file for complete search history.

(56) References Cited

U.S. PATENT DOCUMENTS

| | | | | |
|---|---|---|---|---|
| 3,384,385 | A | 5/1968 | Cohen et al. | |
| 3,830,514 | A | 8/1974 | Green | |
| RE30,890 | E | 3/1982 | Hodge | |
| 4,600,113 | A * | 7/1986 | DeMars | 220/212 |
| 4,691,840 | A | 9/1987 | Ferbrache | |
| 4,981,232 | A * | 1/1991 | Wynn | 220/532 |
| 5,163,577 | A | 11/1992 | Lee | |
| D343,490 | S * | 1/1994 | Ramsey | D34/5 |
| D347,095 | S | 5/1994 | Apps | |
| 5,683,097 | A * | 11/1997 | Fenton et al. | 280/655.1 |
| D388,577 | S | 12/1997 | Rehrig | |
| D398,120 | S | 9/1998 | Rehrig | |
| D410,125 | S | 5/1999 | Rehrig et al. | |
| 5,899,468 | A | 5/1999 | Apps | |
| 5,904,269 | A * | 5/1999 | Wolff | 220/756 |
| 6,019,242 | A * | 2/2000 | Wysocki et al. | 220/571 |
| 6,036,204 | A * | 3/2000 | Craft et al. | 280/47.315 |
| D476,125 | S | 6/2003 | Chen | |
| 6,769,702 | B2 * | 8/2004 | Young | 280/47.26 |
| 2002/0153681 | A1 | 10/2002 | Young | |

FOREIGN PATENT DOCUMENTS

| | | | |
|---|---|---|---|
| CA | 2 344 843 | | 11/2001 |
| DE | 830 171 | | 1/1952 |
| DE | 11 91 740 | | 4/1965 |
| DK | 9 500 261 | U | 10/1996 |
| EP | 1 106 535 | | 6/2001 |
| EP | 1 157 946 | A | 11/2001 |
| GB | 2 338 942 | A | 1/2000 |
| WO | WO 97 46468 | A1 | 12/1997 |
| WO | WO 03/050017 | A1 | 6/2003 |

OTHER PUBLICATIONS

Brochure—Milko Der Milko 42-Liter-Rollerbehalter Minimale Abmessungen Maximaler Vorteil—2 pages—dated 1996.

* cited by examiner

*Primary Examiner* — Mickey Yu
*Assistant Examiner* — Niki Eloshway
(74) *Attorney, Agent, or Firm* — Carlson, Gaskey & Olds

(57) ABSTRACT

A waste container includes fixed handles integrally molded to an upper edge of the side wall. The waste container further includes a retractable handle pivotably mounted at a hinge at the upper edge of the side wall. The retractable handle is pivotable between an upright, use position above the fixed handles and a retracted position below the hinge adjacent the side wall. In this manner, the handle can be moved to the proper location for either pulling the waste container on its wheels or for emptying the waste container into the hopper of a truck.

25 Claims, 10 Drawing Sheets

WASTE CONTAINER

BACKGROUND OF THE INVENTION

The present invention relates generally to containers and, more particularly, to a waste container.

Waste containers typically include a bottom wall and a side wall extending upwardly from the periphery of the bottom wall to define the container. Often, the waste container includes wheels below the side wall to facilitate the transport of a loaded waste container. Many waste containers also include handles. Some waste containers include diametrically opposed short handles, which extend slightly outwardly or slightly upwardly of the top of the side wall. While these handles are useful for lifting the waste container, such as for emptying the waste container into the hopper of a truck, these handles are not well-suited for pulling the waste container on the wheels. Longer handles are more suited to pulling the waste container on the wheels, but inconvenient for lifting the waste container.

SUMMARY OF THE INVENTION

The present invention provides a waste container having a pair of opposed short handles, which are convenient for lifting, and a retractable elongated handle that is movable into a use position where it extends a greater distance above an upper edge of the container, where it is more useful for pulling the waste container on the wheels.

In one embodiment of the waste container according to the present invention, the arm of the elongated handle is pivotable about an axis on the side wall between a retracted downward position and an upright use position. In the retracted position, the handle extends downward adjacent the side wall so that a second, relatively shorter handle, which extends from the side wall, can be used to lift and empty the container. In the use position, the handle extends a greater distance above the upper edge of the container than the second, relatively shorter handle. In the use position, the retractable handle is easier to grasp for use in pulling the waste container on the wheels.

BRIEF DESCRIPTION OF THE DRAWINGS

Other advantages of the present invention can be understood by reference to the following detailed description when considered in connection with the accompanying scale drawings wherein.

DETAILED DESCRIPTION OF THE PREFERRED EMBODIMENT

Figure 1:
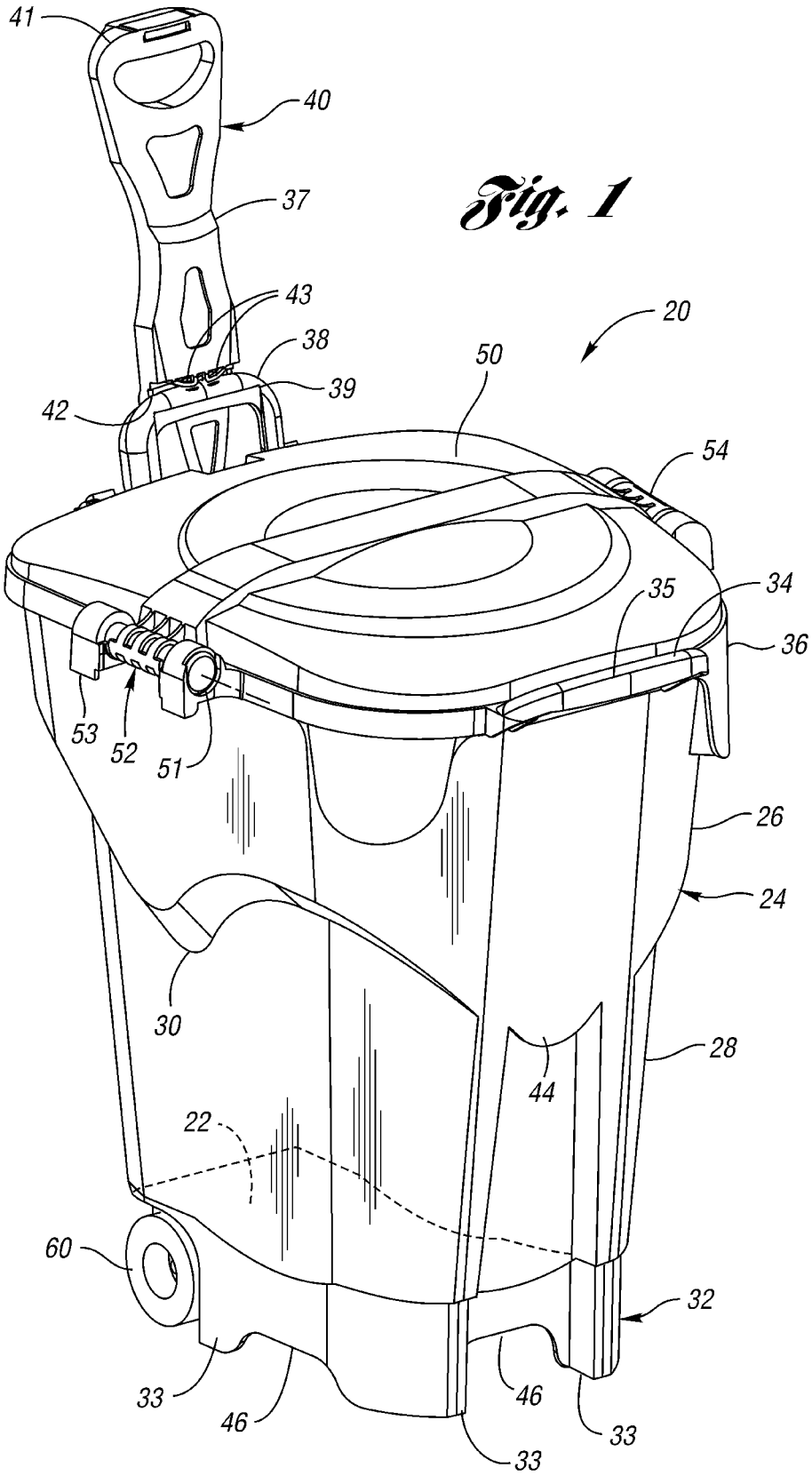
FIG. 1 is a front perspective view of a waste container according to the present invention.

A waste container 20 according to the present invention is shown in FIG. 1. The waste container 20 includes a bottom wall 22 integrally molded with a side wall 24 which extends upwardly from the periphery of the bottom wall 22. The side wall 24 includes an upper portion 26 and a lower portion 28. The upper portion 26 generally has a larger diameter than the lower portion 28. A tapered mid-portion 30 of the side wall 24 connects the upper portion 26 to the lower portion 28. The tapered mid-portion 30 is contoured vertically along the side wall 24 to present an aesthetically pleasing design. A base 32 extends downwardly from the bottom wall 22 beneath the side wall 24 to four feet 33 (three visible in FIG. 1).

The waste container 20 includes a front fixed handle 34 integrally molded with the side wall 24 and having a grip 35 positioned generally upwardly and outwardly from an upper edge 36 of the side wall 24. A rear fixed handle 38 is also integrally molded with the side wall 24 and has a grip 39 positioned generally upwardly and outwardly a first distance from the upper edge 36 of the side wall 24. The waste container 20 further includes retractable handle 40 including a grip 41 at an outer end of an arm 37. The handle 40 is shown in FIG. 1 in the upright, use position, where the grip 41 is positioned a second distance (which is greater than the first distance) upwardly and slightly outwardly from the upper edge 36. The retractable handle 40 includes a recess 42 into which the grip 39 of the rear fixed handle 38 is snap-fit and removably retained by flexible tabs 43 (also shown in FIG. 4).

An integrally-molded lip 44 extends downwardly parallel to the front of the side wall 24. Similar integrally-molded lips 46 extend downwardly from front and side peripheral edges of the base 32. The lips 44, 46 can be grasped to assist in inverting the waste container 20 to dump the contents.

A lid 50 is pivotable about an axis 51 at the upper edge 36 of the side wall 24. The lid 50 is connected to the upper edge 36 of the side wall 24 via a hinge 52. The hinge 52 includes a catch tab 53 protruding downwardly. When the lid 50 is opened completely, such that it hangs down adjacent the side wall 24, the lid 50 will snap behind the catch tab 53, thereby preventing the lid 50 from closing or getting in the way while the waste container 20 is inverted for dumping the contents.

Figure 2:
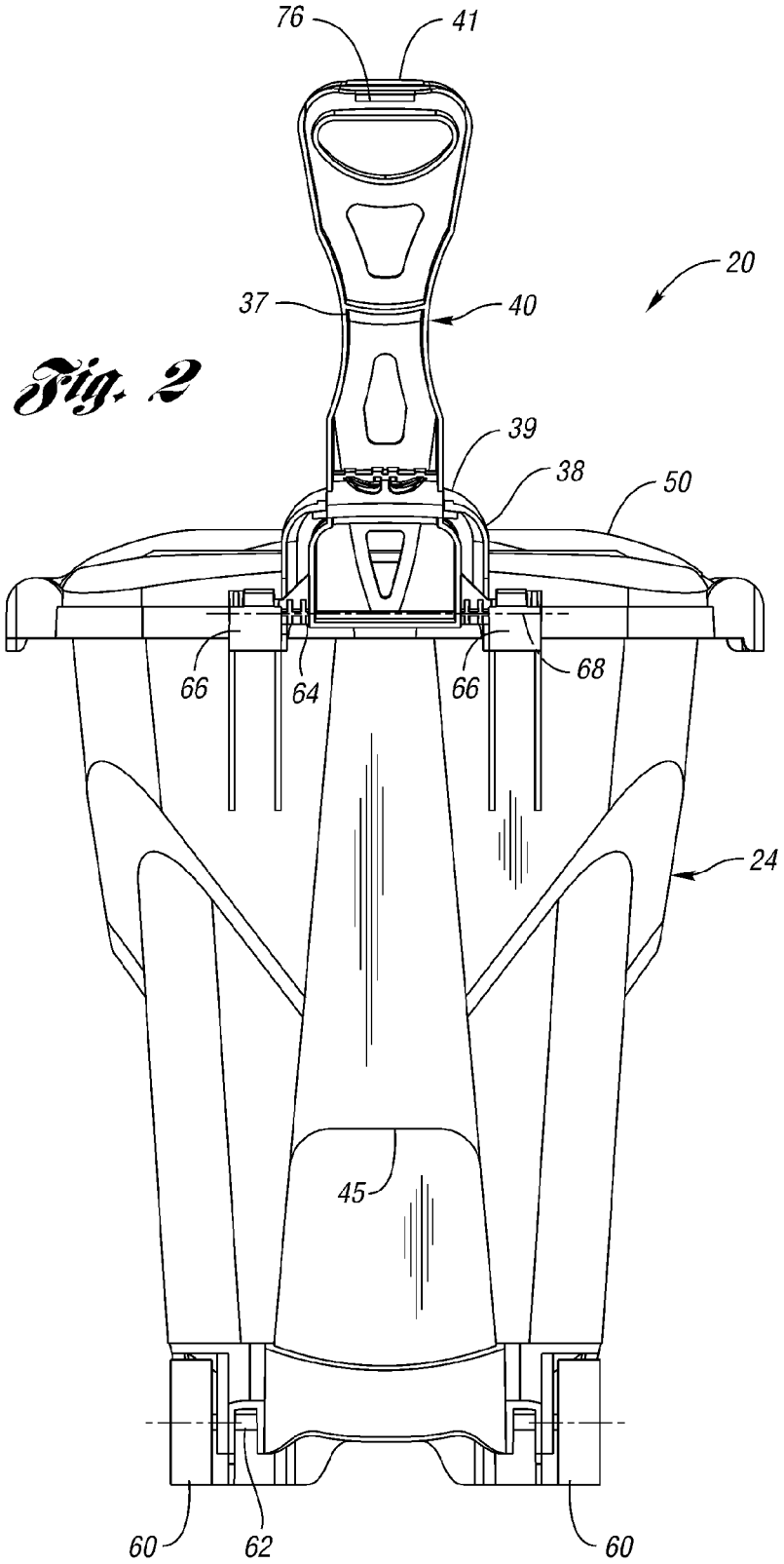
FIG. 2 is a rear view of the waste container of FIG. 1.

A latch 54 (also shown in FIG. 4) opposite the hinge 52 removably secures the lid 50 to the upper edge 36 of the side wall 24 in an interference fit or latch mechanism. The hinge 52 and latch 54 protrude laterally from the upper edge 36 of the side wall 24 and therefore can also be grasped for lifting and dumping the waste container 20. The waste container 20 further includes a pair of wheels 60 mounted on an axle 62 (FIG. 2) for rotation relative to the waste container 20. The waste container 20 contacts the ground at six contact areas: the two wheels 60 and the four feet 33 of the base 32. As can be seen in FIG. 2, the side wall 24 includes an integrally-molded graspable lip 45 extending downward parallel to a rear surface of the side wall 24. As will be further noted, the axis 68 is generally parallel to the axle 62 (FIG. 2).

The handle 40 extends from an integrally-molded hinge pin 64 parallel to the first grip 41. The hinge pin 64 is rotatably retained in hinge receivers 66, such that the handle 40 is pivotable about an axis 68 extending axially through the hinge pin 64. A snap-fit tab 76 extends rearwardly from the grip 41, as is also shown in FIG. 3.

Figure 3:
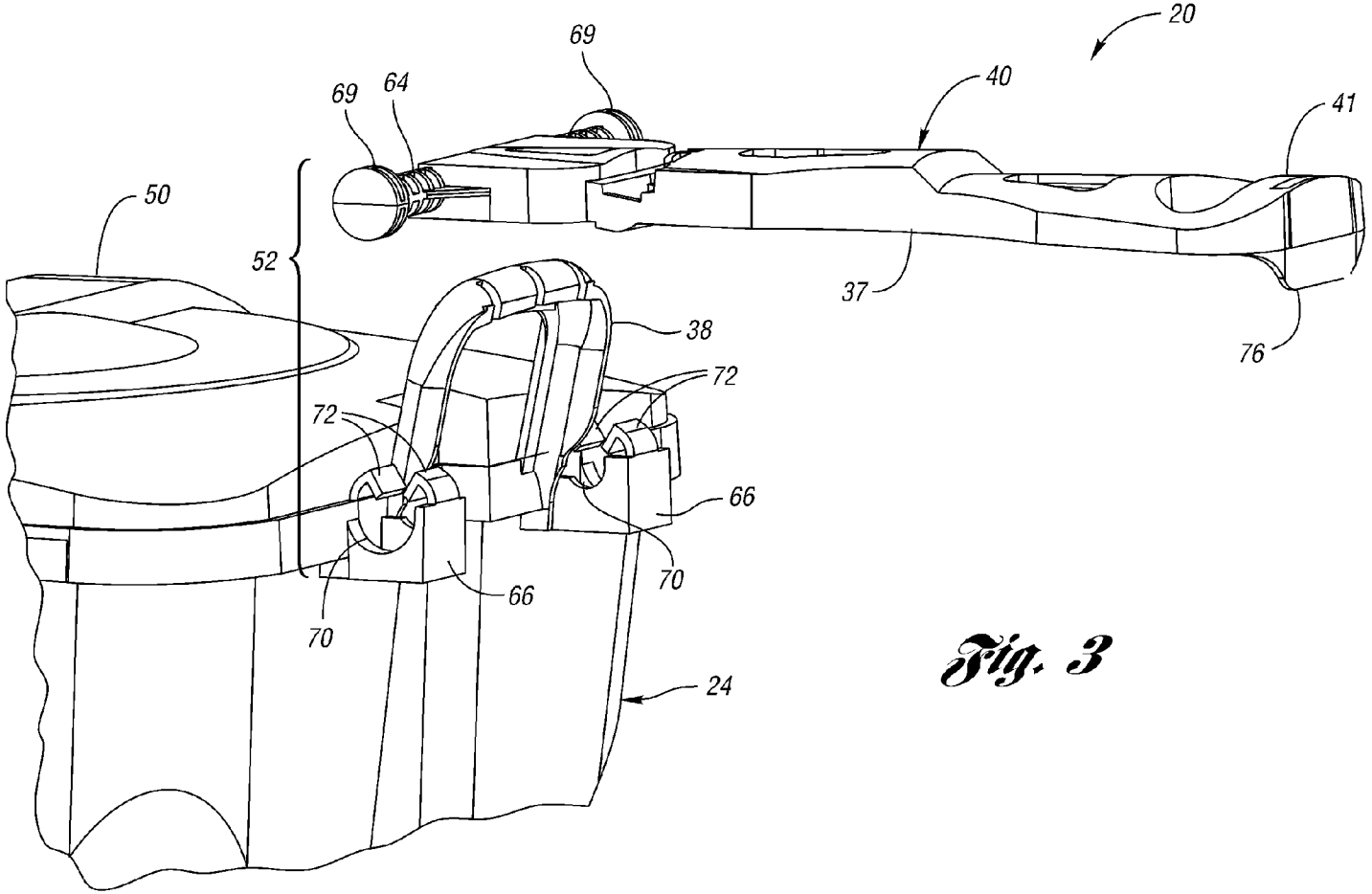
FIG. 3 illustrates the waste container with the handle exploded from the container.

FIG. 3 shows the handle 40 exploded from the waste container 20. The hinge pin 64 on the handle 40 has disks 69 on each axial end for preventing lateral movement in the hinge receivers 66. The disks 69 have a larger diameter than the remainder of the hinge pin 64. The hinge receivers 66 each include concave surfaces 70 for supporting the hinge pin 64 and a pair of opposed, angled tabs 72. A snap-fit tab 76 extends rearwardly from the grip 41.

Figure 4:
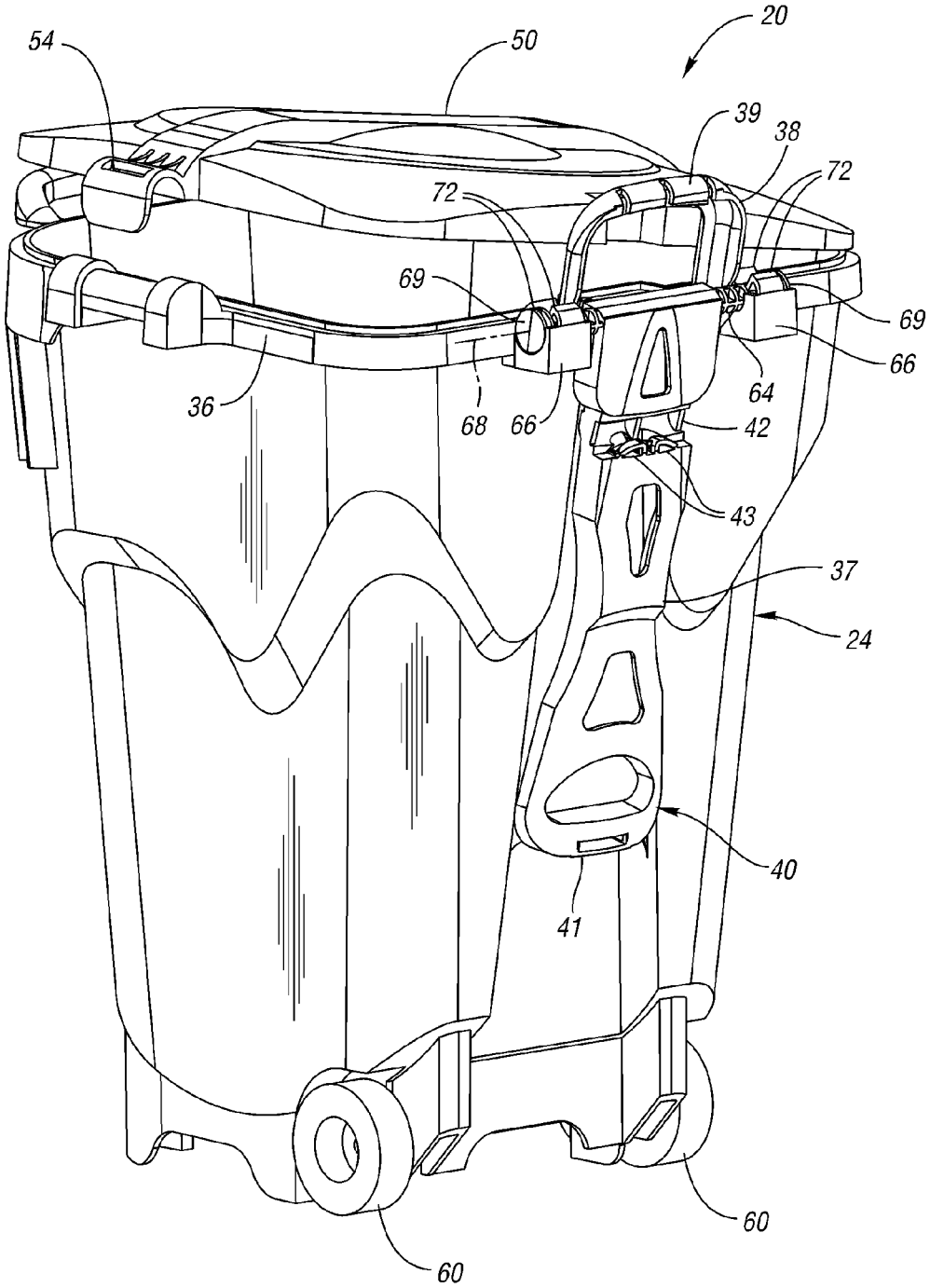
FIG. 4 is a rear perspective view of the waste container, with the lid partially open and with the handle in the retracted position.

In FIG. 4, the hinge pin 64 is snap-fit into the hinge receivers 66 and retained by the angled tabs 72. The disks 69 on the hinge pin 64 abut the edges of the angled tabs 72 to prevent movement along the axis 68. FIG. 4 illustrates the lid 50 of waste container 20 in a slightly open position. The lid 50 is hingeably connected by hinge 52 (FIG. 1) to the upper edge 36 of the side wall 24.

Figure 5:
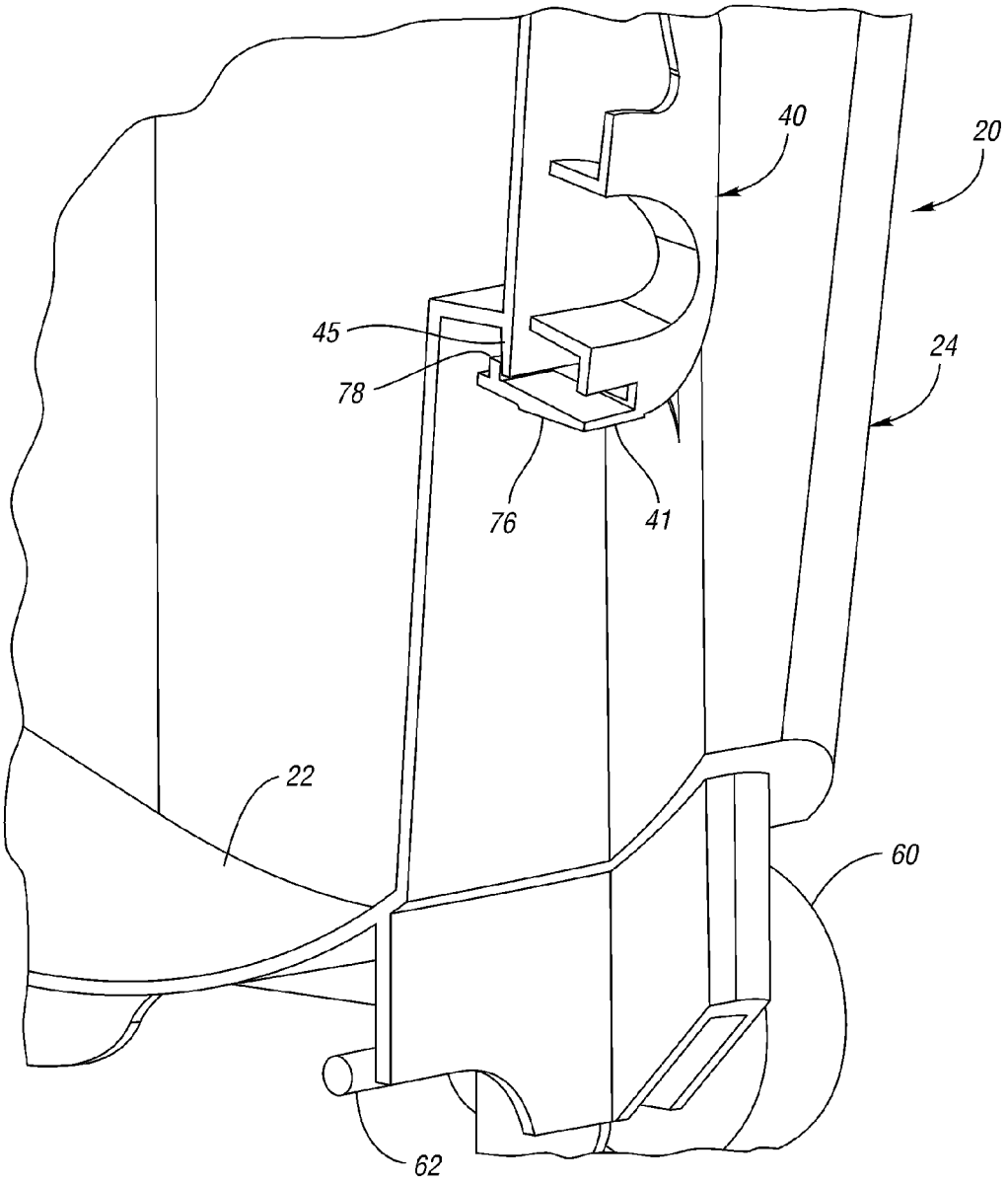
FIG. 5 is an enlarged, cross-sectional view of the grip of the handle in the retracted position.

FIG. 5 is an enlarged sectional view of the grip 41 of the handle 40 in the retracted position where the tab 76 on handle 40 is snap-fit to the rear lip 45. An upward projection 78 snaps behind the rear lip 45 to retain the handle 40 in the retracted position when the waste container 20 is inverted for emptying. As can also be seen in FIG. 5, the bottom wall 22 is generally concave and the side wall 24 extends generally upwardly from a periphery of the bottom wall 22.

Figure 6:
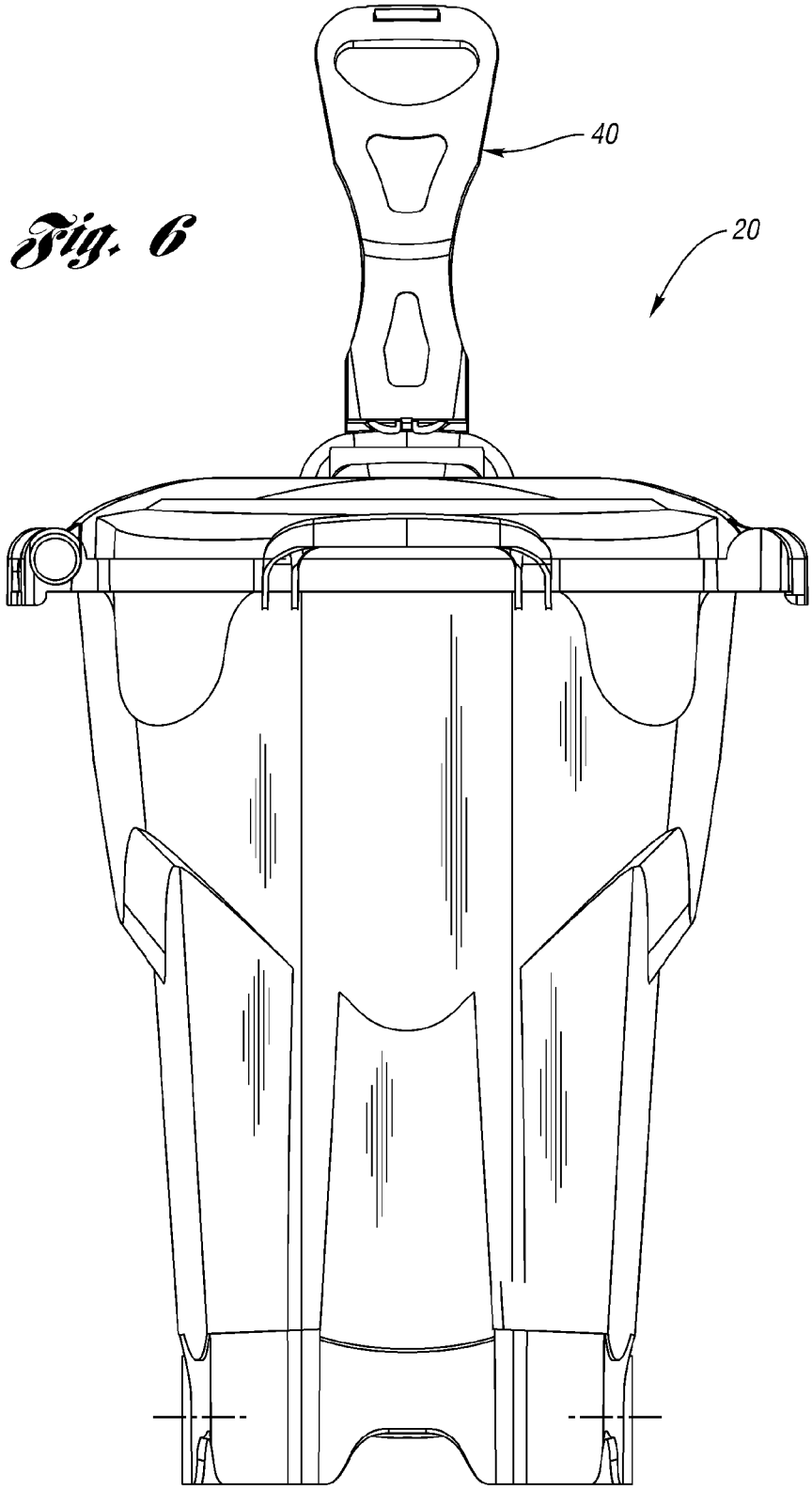
FIG. 6 is a front view of the waste container.
Figure 7:
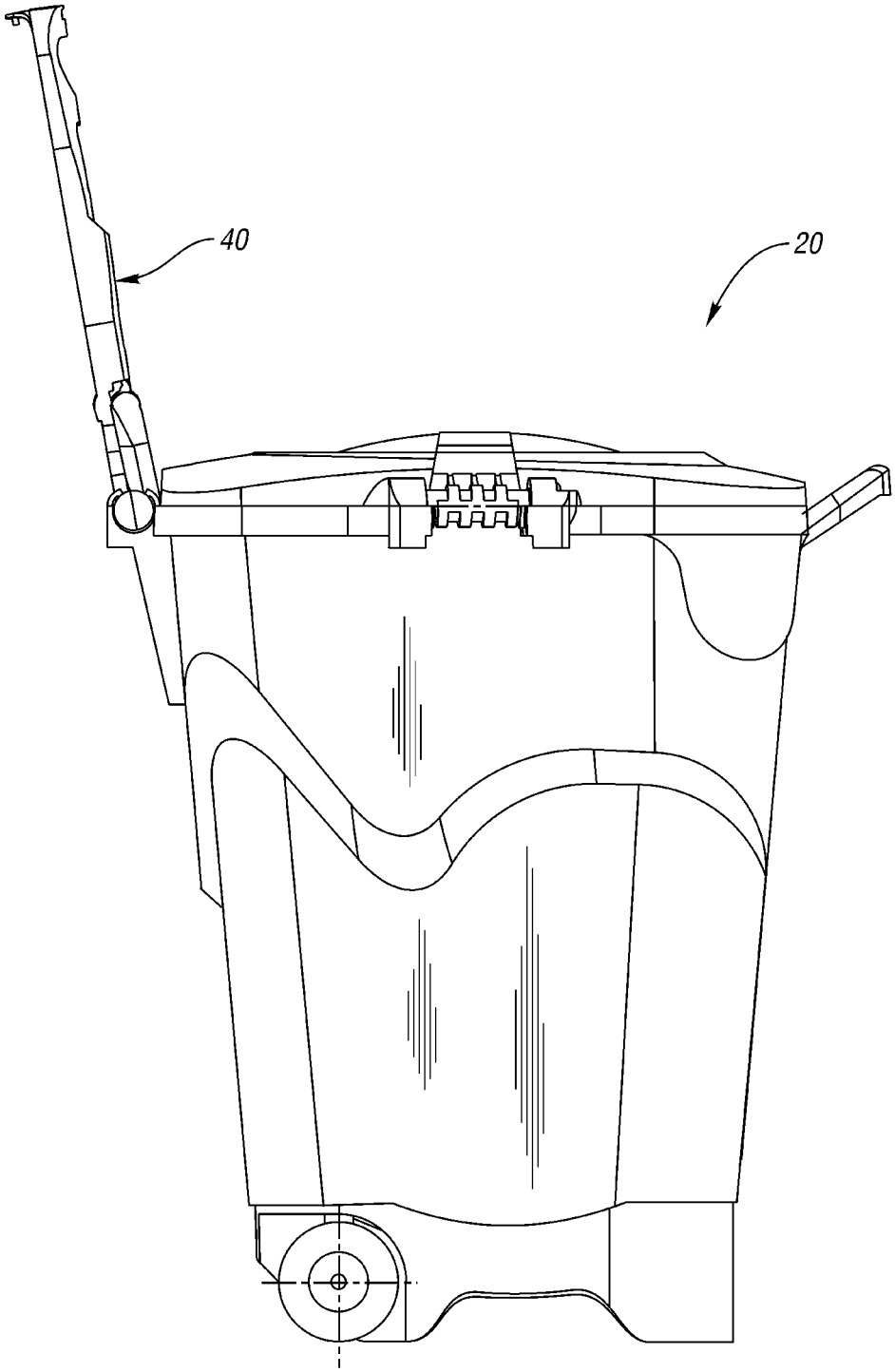
FIG. 7 is a side view of the waste container.

FIG. 6 is a front view of the waste container 20 according the present invention, with the handle 40 in the extended, upright, use position. FIG. 7 is a side view of the waste container 20 according to the present invention.

Figure 8:
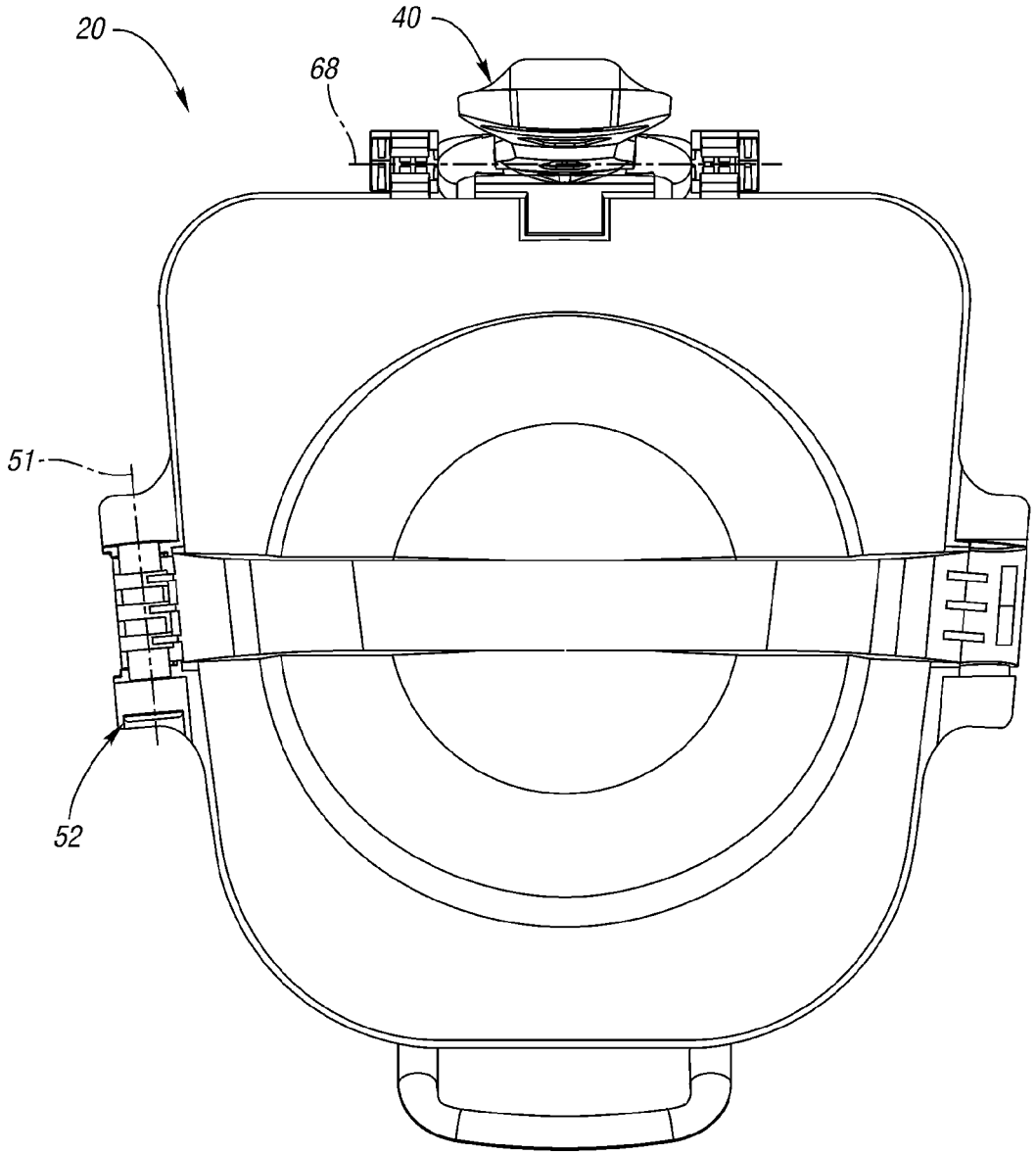
FIG. 8 is a top view of the waste container.
Figure 9:
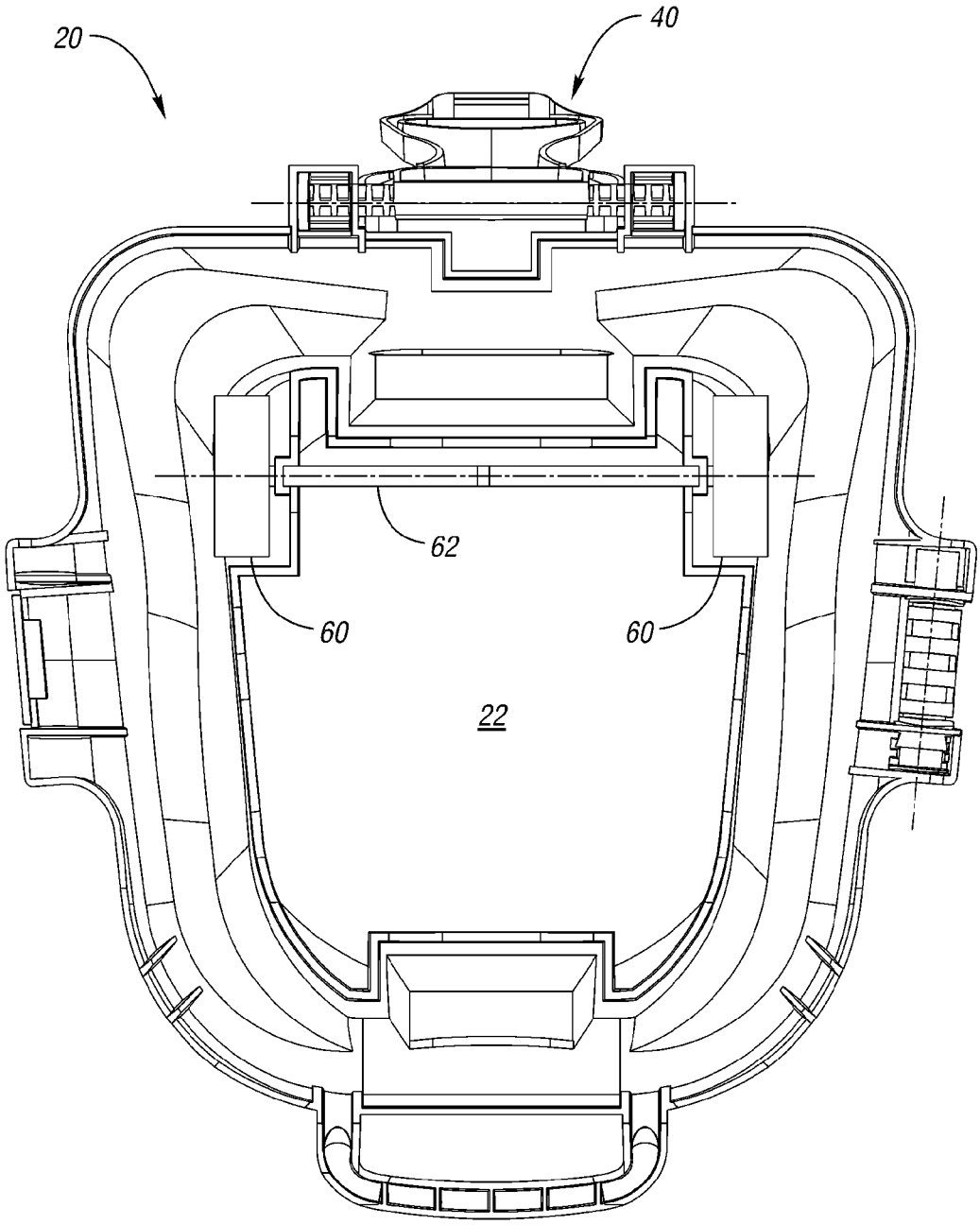
FIG. 9 is a bottom view of the waste container.

FIG. 8 is a top view of the waste container 20. The axis 51 about which the lid 50 is pivotable is substantially parallel to that portion of the upper edge 36 adjacent the hinge 52. The axis 68 of the handle 40 is substantially perpendicular to the axis 51 of the hinge 52. In the embodiment shown, the axes 51, 68 are approximately 85 degrees relative to one another; however, angles between approximately 70-110 degrees would be considered generally perpendicular. FIG. 9 is a bottom view of the waste container 20.

In use, the handle 40 is pivotable between the upright, use position shown in FIG. 2, to the retracted position shown in FIG. 4, where the handle 40 extends downwardly from the hinge pin 64 adjacent the side wall 24. In the retracted position, lifting and emptying the container 20, for example, into the hopper of a truck is facilitated. When the handle 40 is in its retracted position, the rear lip 45 is still accessible below the grip 41 to assist in inverting the container 20 to dump the contents. The handle 40 can be selectively rotated upward about its axis 68 until the grip 41 is in the upright, use position as shown in FIG. 2. In the upright position (FIG. 2), the waste container 20 is easier to tip back onto its wheels 60 for pulling by the user.

Figure 10:
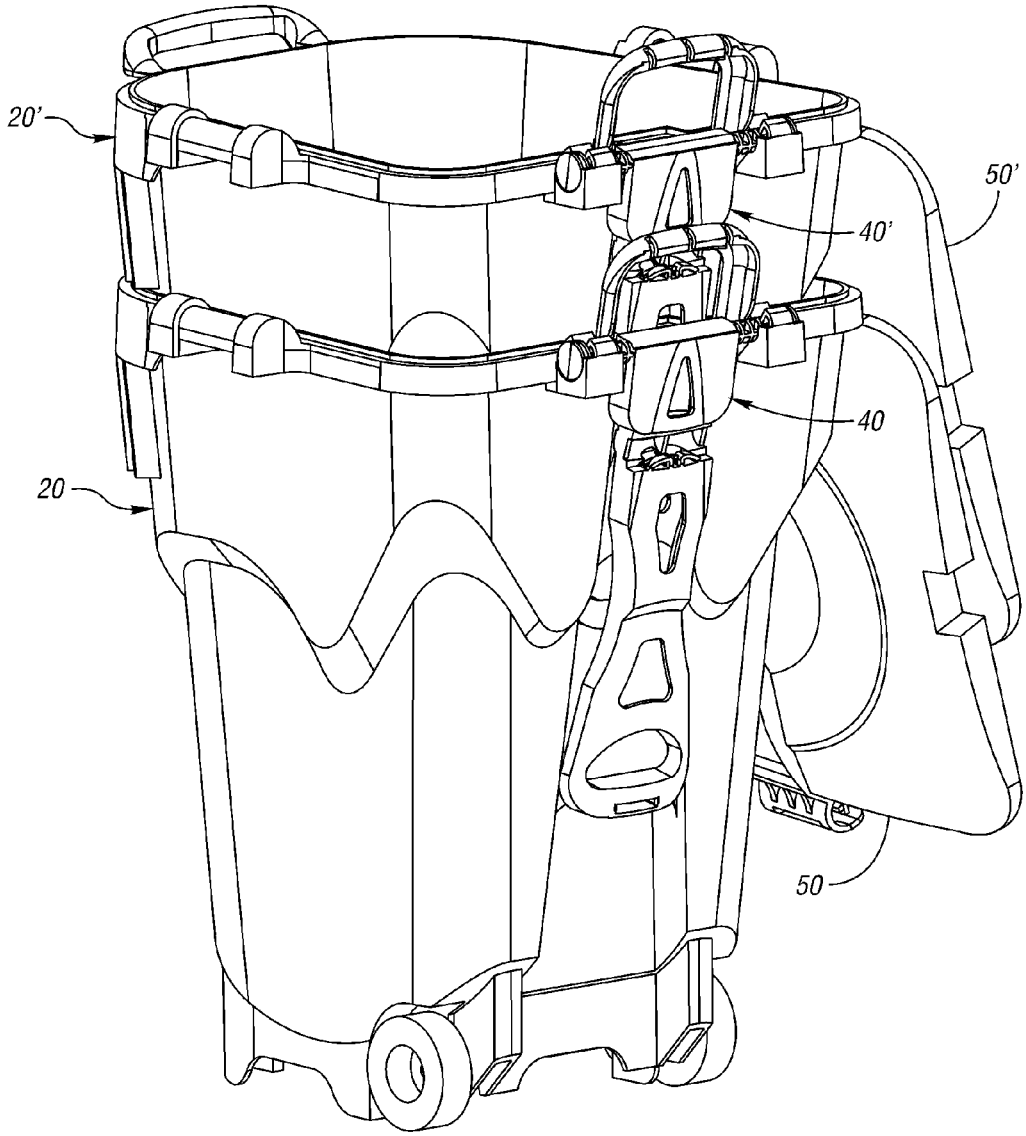
FIG. 10 is a perspective view of the waste container with a similar waste container nested therein.

When not in use, the waste container 20 can be stored or shipped as shown in FIG. 10, which illustrates a waste container 20' similar to waste container 20. As shown, the waste container 20' can be substantially nested in waste container 20 with the handle 40' inserted within the side wall 24 and with the lids 50, 50' opened, but still attached.

The waste container 20, handle 40 and lid 50 are each preferably injection molded of high density polyethylene, but other suitable materials could also be used. The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A waste container comprising:

a bottom wall;

a sidewall extending upwardly from a periphery of the bottom wall;

a first grip integrally molded with the sidewall; and an arm extending from an axis to a second grip, the arm pivotably mounted to the sidewall at the axis and being pivotable between a retracted position below the first grip and a use position above the first grip, the arm selectively connected to the first grip when the arm is in the use position and disconnected from the first grip when the arm is in the retracted position, the first grip at least partially disposed at a distance from the bottom wall greater than an uppermost edge of the sidewall when the arm is in the retracted position.

2. The waste container of claim 1 wherein the second grip is above the upper edge of the sidewall when the arm is pivoted to the use position.

3. The waste container of claim 2 wherein the second grip is positioned substantially above the first grip when the arm is pivoted to the use position.

4. The waste container of claim 3 wherein the first and second grips are both above a plane defined by the upper edge of the sidewall when the arm is pivoted to the use position.

5. The waste container of claim 1 further including a lid pivotable about a hinge axis at an upper edge of the sidewall, the hinge axis generally perpendicular to the axis of the arm.

6. The waste container of claim 1 further including at least one wheel generally disposed below the sidewall and rotatable about a wheel axis at least substantially parallel to the axis about which the arm pivots.

7. The waste container of claim 1 wherein the arm is integrally molded with the second grip and with a hinge pin at the axis, wherein the hinge pin is rotatably received within a hinge receiver integrally molded with the sidewall.

8. The waste container of claim 1 wherein the arm is selectively securable to the sidewall when the arm is the retracted position.

9. The waste container of claim 8 further including a snap-fit connection between the arm and the sidewall selectively securing the arm to the sidewall when the arm is in the retracted position.

10. The waste container of claim 1 wherein the first grip includes a hand-receiving recess at least partially disposed above the uppermost edge of the sidewall.

11. The waste container of claim 10 wherein the first grip is projecting upwardly from the sidewall.

12. A waste container comprising:

a bottom wall;

a sidewall extending upwardly from a periphery of the bottom wall;

a first grip integrally molded with the sidewall; and an arm extending from an axis to a second grip, the arm pivotably mounted to the sidewall at the axis and being pivotable between a retracted position below the first grip and a use position above the first grip, wherein the arm connects to the first grip when the arm is pivoted to the use position, wherein the arm includes a recess into which the first grip is received when the arm is in the use position, the first grip at least partially disposed at a distance from the bottom wall greater than an uppermost edge of the sidewall when the arm is in the retracted position.

13. The waste container of claim 12 wherein the first grip snap-fits into the recess in the arm when the arm is pivoted to the use position.

14. A waste container comprising:

a bottom wall;

a sidewall extending upward from a periphery of the bottom wall;

a first grip secured to the sidewall, the first grip projecting upwardly and outwardly from the a sidewall; and an arm pivotably mounted to the sidewall and pivotable relative to the first grip and the sidewall between a downward position and an upright use position, wherein the arm snap-connects into the upright use position, a second grip on an outer end of the arm extending above the first grip when the arm is in the use position, wherein the first grip snap-fits to the arm when the arm is pivoted to the use position.

15. The waste container of claim 14 wherein the arm extends from an axis at the upper edge of the sidewall to the second grip.

16. The waste container of claim 14 further including a lip extending downward from an upper edge of the sidewall, the first grip extending upwardly above the lip.

17. The waste container of claim 14 further including a lip extending downward from an upper edge of the sidewall, the arm pivotably mounted by a hinge, the hinge mounted to the sidewall not below the lip.

18. A waste container comprising:

a bottom wall;

a sidewall extending upward from a periphery of the bottom wall;

a first grip secured to the sidewall, the first grip projecting upwardly and outwardly from the sidewall; and an arm pivotably mounted to the sidewall and pivotable relative to the first grip and the sidewall between a downward position and an upright use position, wherein the arm snap-connects into the upright use position, a second grip on an outer end of the arm extending above the first grip when the arm is in the use position, wherein the arm connects to the first grip when the arm is pivoted to the use position, wherein the arm includes a recess into which the first grip is received when the arm is in the use position.

19. A waste container comprising:

a bottom wall;

a sidewall extending upward from the bottom wall and extending about a periphery of the bottom wall;

a pair of handles integrally molded with the sidewall and protruding upwardly from the sidewall; and an arm pivotably connected to the sidewall, a grip formed at an outer end of the arm, wherein the arm is selectively connectable to one of the pair of handles when the arm is pivoted to a use position and selectively disconnectable from the one of the pair of handles to pivot the arm to a retracted position.

20. The waste container of claim 19 further including a lid pivotably connected at an upper edge of the sidewall.

21. The waste container of claim 19 wherein the arm is pivotable about an axis from which one of the pair of handles extends.

22. The waste container of claim 19 wherein the arm is integrally molded with the grip and a hinge pin that is rotatable in a hinge receiver integrally molded to the sidewall.

23. The waste container of claim 19 wherein the arm is pivotably connected adjacent an upper edge of the sidewall.

24. The waste container of claim 23 wherein the arm is selectively connectable to one of the pair of handles.

25. The waste container of claim 24 wherein the arm is connectable to the one of the pair of handles at a point above the sidewall.

* * * * *

UNITED STATES PATENT AND TRADEMARK OFFICE

CERTIFICATE OF CORRECTION

PATENT NO. : 8,424,715 B2
APPLICATION NO. : 10/442716
DATED : April 23, 2013
INVENTOR(S) : Cynthia R. Aiken It is certified that error appears in the above-identified patent and that said Letters Patent is hereby corrected as shown below:

IN THE CLAIMS:

In claim 2, column 4, line 9; delete “upper” and insert --uppermost--

In claim 4, column 4, line 15; delete “upper” and insert --uppermost--

Signed and Sealed this
Seventeenth Day of March, 2015

Michelle K. Lee

Michelle K. Lee
*Director of the United States Patent and Trademark Office*